United States Patent [19]

Luijten

[11] Patent Number: 4,746,265

[45] Date of Patent: May 24, 1988

[54] HIGH-VACUUM MOLECULAR PUMP

[75] Inventor: Waltherus J. Th. H. Luijten, Almelo, Netherlands

[73] Assignee: Ultra-Centrifuge Nederland B.V., Almelo, Netherlands

[21] Appl. No.: 449,691

[22] Filed: Dec. 14, 1982

[30] Foreign Application Priority Data

Dec. 14, 1981 [NL] Netherlands ..... 8105614

[51] Int. Cl.[4] ..... F01D 1/36

[52] U.S. Cl. ..... 415/90

[58] Field of Search ..... 415/73, 76, 90, 206, 415/208; 366/307

[56] References Cited

U.S. PATENT DOCUMENTS

| | | | |
|---|---|---|---|
| 2,730,297 | 1/1956 | Van Dorsten et al. | 415/90 X |
| 3,832,084 | 8/1974 | Maurice | 415/90 |
| 3,967,914 | 7/1976 | Gamell | 415/90 |
| 4,036,565 | 7/1977 | Becker | 415/90 X |
| 4,270,882 | 6/1981 | Luijten et al. | 415/90 X |

FOREIGN PATENT DOCUMENTS

| | | | |
|---|---|---|---|
| 2411247 | 3/1973 | Fed. Rep. of Germany | 415/90 |
| 868124 | 9/1981 | U.S.S.R. | 415/90 |

OTHER PUBLICATIONS

A New Molecular Pump, by Louis Maurice, Japan. J. Appln. Phys. Suppl. 2, Pt. 1, 1974.

*Primary Examiner*—Robert E. Garrett
*Assistant Examiner*—Joseph M. Pitko
*Attorney, Agent, or Firm*—Cushman, Darby & Cushman

[57] ABSTRACT

A high-vacuum molecular pump includes at least two coaxial elements (1 and 2) mounted rotatably with respect to each other and at a small distance from each other. A side of one of the elements (1) positioned opposite a side of another element (2) is provided with at least one helical groove (5), and a pump space (6) is present between these two sides of the elements, which pump space (6) is in communication with a gas supply (7) and a gas discharge (10,8). Near an end of a pair of elements (1 and 2) is a substantially annular gas supply chamber (9) which is bounded by these elements (1 and 2), the annular gas supply chamber (9) being in communication with the gas supply (7) and with the pump space (6) between the two elements (1 and 2), the helical groove (5) extending into the annular gas supply chamber (9). The elements (1 and 2) bounding the annular gas supply chamber (9) are so shaped that the annular gas supply chamber (9) is relatively wide near the gas supply (7), but narrows gradually downstream.

6 Claims, 3 Drawing Sheets

HIGH-VACUUM MOLECULAR PUMP

The invention relates to a high-vacuum molecular pump comprising at least two coaxial elements mounted rotatably with respect to each other and at a small distance from each other, wherein a side of one of the elements positioned opposite a side of another element is provided with at least one helical groove, and wherein a pump space is present between these two sides of the elements, which pump space is in communication with a gas supply and a gas discharge.

Pumps of this kind, designed for creating and maintaining a very high vacuum, are known, for example from U.S. Pat. No. 2,730,297, British Patent Specification No. 1,588,374, and from the article "A new molecular pump" by Louis Maurice in Japan. J. Appl. Phys. Suppl. 2 Pt. 1, 1974.

These pumps use the so-called "molecular drag" principle, which will be explained below.

When one of the elements (called the rotor for simplicity) rotates very rapidly relative to the other element (called the stator for simplicity), the following process will take place in the pump space between rotor and stator at a gas pressure which is so low that the free path of the gas molecules is greater than the dimensions of the pump space containing the molecules.

Each gas molecule that collides with the very rapidly rotating rotor will, on leaving the rotor surface, have, in addition to the velocity related to its temperature, received a velocity component in the direction of the rotor's rotation. Because of the low gas pressure, a molecule leaving the rotor will not change its direction through collision with another molecule, but will finally collide with the side of the stator opposite the rotor and will rebound towards the rotor. This process keeps being repeated and results in the molecules moving in the rotor's direction of rotation. Because the side of the stator facing the rotor is provided with at least one helical groove, the result will be molecular transport in the direction of the groove and also perpendicular to the direction of the groove. This is because the rotor's circumferential velocity can be resolved into these two directions.

The velocity component of the molecules in the groove direction determines the compression ratio and the pumping speed. The pumping speed is the number of volume units of gas transported by the pump from the low pressure side of the pump to the high pressure side of the pump per unit of time. The velocity component of the molecules perpendicular to the groove direction gives rise to a leak effect, which, however, is insignificant compared to the pumping speed.

It is clear that it is attractive to obtain a pumping speed which is as high as possible. This can be achieved by designing the pump so that the rotor rotates at a very high speed, e.g. such that the circumferential speed of the rotor reaches values in the order of magnitude of 200 to 400 m/s. There are, of course, limits to the speed at which the rotor can rotate, since very high speeds create great mechanical problems.

The applicant has now found that, for a given rotor speed, it is possible to increase the pumping speed in a simple manner by employing an improved embodiment of the pump of the above kind.

To this end the above pump is characterized according to the invention in that near an end of a pair of elements a substantially annular gas supply chamber is present which is bounded by these elements, that said annular gas supply chamber is in communication on the one hand with the gas supply and on the other hand with the pump space between the two elements, that the helical groove extends into the annular gas supply chamber, and that the elements which bound the annular gas supply chamber are so shaped that the annular gas supply chamber is relatively wide near the gas supply, but narrows gradually downstream.

By employing this substantially annular gas supply chamber, which is relatively wide near the gas supply, the very fast moving gas molecules in the gas supply are very effectively captured by the annular gas supply chamber. Owing to the special shape of the annular gas supply chamber, the captured molecules move graduaiiy towards the pump space by a process of collision and impulse transfer as described above.

Some embodiments ot the high-vacuum pump according to the invention will now be described with reference to the drawings, in which.

Figure 1:
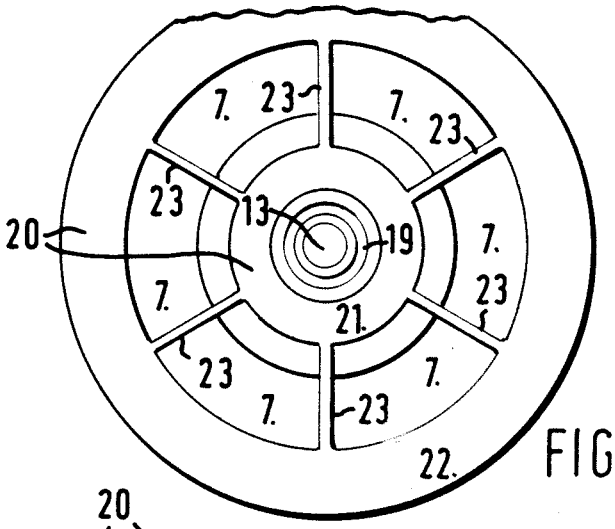
FIG. 1 is a plan view of a pump according to the invention.

The pump according to the invention comprises essentially two coaxial elements 1 and 2. The element 1 forms the stator and is a hollow, fixed casing 1. The element 2 is rotatably arranged within the element 1 and forms the rotor 2 of the pump.

The rotor 2 is rotatably mounted within the casing or the stator 1 by means of bearings. To this end the rotor 2 is provided at its bottom with a shaft 12 and at its top with a shaft 13. The lower shaft 12 is supported by a suitable bearing 14 mounted in a cover 15. The cover 15 is attached to a support 16. This support 16 is attached to the casing 1. Within the support 16 a stator 17 of an electric motor is mounted which can interact with a rotor 18 of the same electric motor, said rotor 18 being fixed to the shaft 12.

The top shaft 13 is supported by a suitable bearing 19, for example a magnetic bearing. This bearing 19 is mounted in a cover 20 that, for example by means of bolts (not shown), is fixed to the top of the casing or element 1. The cover 20 comprises two concentric rings 21 and 22 joined together by a number of radial spokes 23 such that channels 7 are formed between the spokes 23.

The casing or element 1 is hollow, its inner side 3 being substantially frusto-conical in shape. The side 3 is provided with at least one helical groove 5. The outer side 4 of the element 2 is substantially circle-cylindrical. Between the juxtaposed sides 3 and 4 of the elements 1 and 2 respectively a pump space 6 is formed.

The pump space 6 communicates via an annular gas supply chamber 9 with a gas supply 7, which in this embodiment consists of the aforementioned channels 7 in the cover 20. A gas discharge 8 also communicates with the pump space 6 via an annular space 10.

The annular gas supply chamber 9 is located near an end of the elements 1 and 2. The annular gas supply chamber 9 is also bounded by the elements 1 and 2, the elements 1 and 2 which bound the annular gas supply chamber 9 being so shaped that the annular gas supply chamber 9 is relatively wide near the gas supply 7, but narrows gradually downstream. The downstream direction in this context is the direction of the gas supply 7 to the pump space 6. The helical groove 5 extends into the annular gas supply chamber 9.

Figure 3:
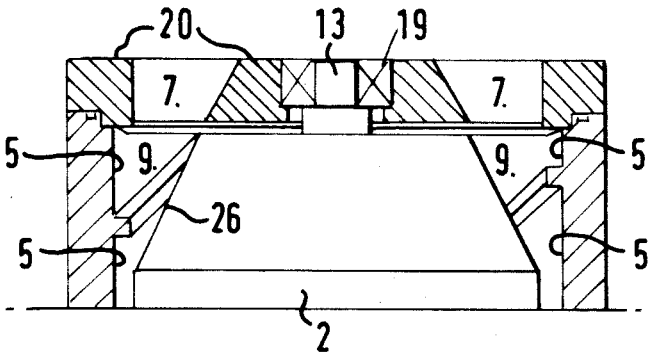
FIG. 3 is a longitudinal section of a second embodiment of the gas supply chamber.
Figure 4:
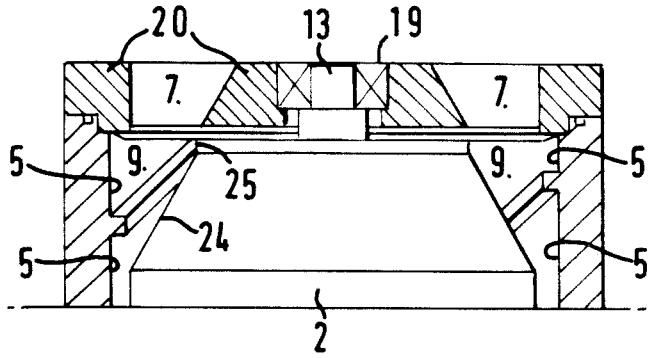
FIG. 4 is a longitudinal section of a third embodiment of the gas supply chamber.
Figure 5:
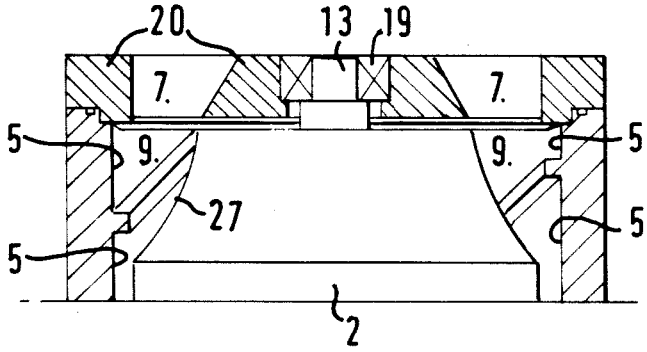
FIG. 5 is a longitudinal section of a fourth embodiment of the gas supply chamber.
Figure 6:
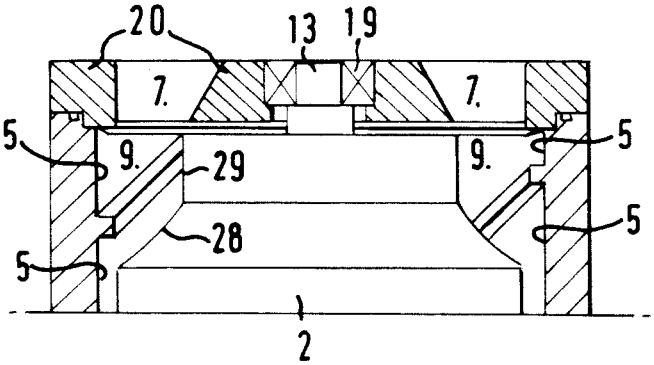
FIG. 6 is a longitudinal section of a fifth embodiment of the gas supply chamber.

The narrowing of the annular gas supply chamber 9 in a downstream direction can be obtained in a number of ways. In the embodiment according to FIGS. 2 and 4 this results from the element 2 having at one end a frusto-conically shaped part 24 joined to a circle-cylindrical part 25. In the embodiment according to FIG. 3 the element 2 has a frusto-conically shaped part 26 only. In the embodiment according to FIG. 5 the element 2 is provided with a part 27 having the shape of a surface of revolution obtained by revolving a curved line about the axis of rotation of the rotor 2. In the embodiment according to FIG. 6 a part 28 is employed that is identical to part 27 of FIG. 5, but which is joined to a circle-cylindrical part 29.

During normal use of the above described pump there will be a very low pressure at the suction side of the pump, i.e. in the gas supply 7. The gas molecules in the gas supply 7 move with great speed, in the order of magnitude of 500 m/s. As the annular gas supply chamber 9 is wide near the gas supply 7 (in a radial direction), many molecules will enter the annular gas supply chamber 9.

The "captured" molecules will bounce backwards and forwards in the annular gas supply chamber 9 between the surface (24, 25; 26; 27; 28, 29) of the rotor 2 and the inner side 3 of the stator 1 provided with the helical groove 5. During this process the rotor 2 will impart a velocity component to the molecules in the direction of rotation of the rotor 2. Because of the helical groove 5 extending into the annular gas supply chamber 9, the captured molecules in the annular gas supply chamber 9 will move towards the pump space 6 as explained above.

In the pump space 6 the molecules are similarly transported so that they finally reach the annular space 10 and the gas discharge 8.

The applicant has found that incorporation of the above described annular gas supply chamber 9 results in a significant increase of the pumping speed for a given rotor speed.

Figure 2:
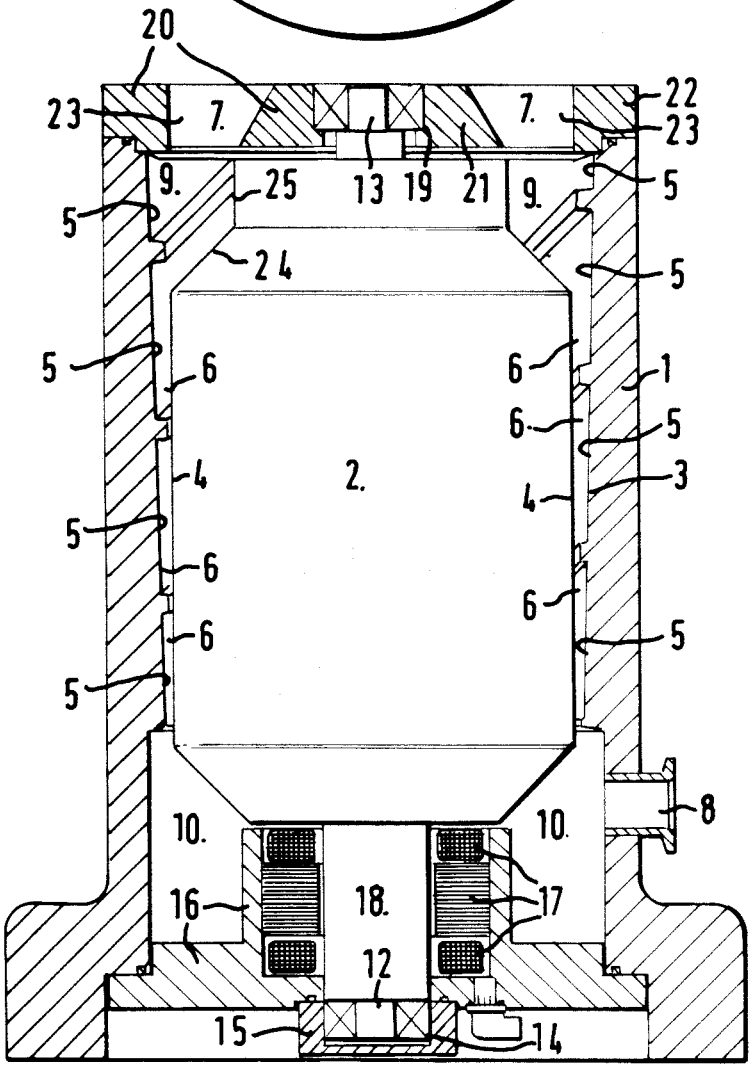
FIG. 2 is a longitudinal section of the same pump provided with a first embodiment of the gas supply chamber.
Figure 7:
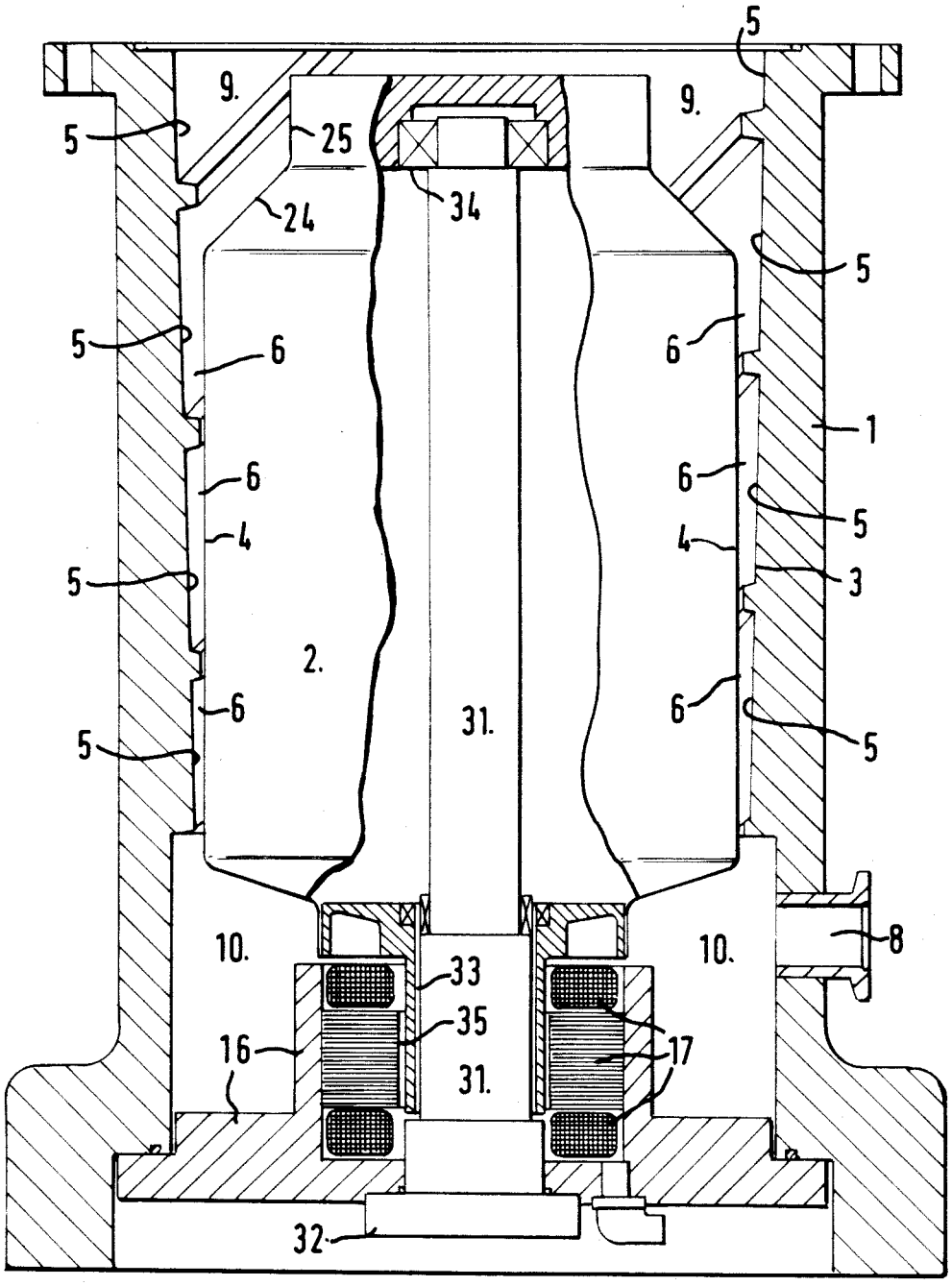
FIG. 7 is a longitudinal section of a somewhat modified embodiment of the pump according to FIG. 2.

The embodiment according to FIG. 7 is basically similar to the embodiment according to FIG. 2. Identical components are therefore indicated by the same reference numerals. The main difference is that the rotor 2 can rotate about a fixed shaft 31 which is entirely enclosed by the rotor 2. With the aid of a flange 32, this shaft 31 is immovably connected to the support 16. The rotor 2 is rotatabiy mounted on the shaft 31 by means of suitable bearings 33 and 34. The rotor 35 of the electric motor 17 is immovably connected to the rotor 2. The top bearing 34 which is for example a magnetic bearing, is, as shown in FIG. 7, fully enclosed by the rotor 2. This is the main difference with the embodiment shown in FIG. 2.

The only detail in which the gas supply of the embodiment according to FIG. 7 differs from the gas supply 7 according to FIGS. 1 and 2 is that the spokes 23 can be made much lighter, i.e. thinner in the axial direction. This is because the spokes 23 are less heavily loaded, since the inner concentric ring 21 does not need to support a rotor bearing. In this case the element 21 could optionally have the form of a solid truncated cone.

I claim:

1. High-vacuum molecular pump comprising at least two coaxial elements mounted rotatably with respect to each other and close to each other so that a narrow pump space is formed between said elements, at least one helical groove in one of said elements and extending through the pump space, and a substantially annular gas supply chamber at an end of a pair of said elements which is bounded by parts of said elements, which annular gas supply chamber is arranged between a gas supply and the pump space and is in communication therewith, wherein the parts of said elements which bound the annular gas supply chamber are so shaped that near the gas supply the annular gas supply chamber is wide relative to the pump space and narrows gradually downstream towards the pump space, and wherein said helical groove continues beyond the pump space and along the full axial length of the annular gas supply chamber.

2. High-vacuum molecular pump according to claim 1, characterized in that the juxtaposed sides of the elements are substantially surfaces of revolution.

3. High-vacuum molecular pump according to claim 2, characterized in that said surfaces of revolution include parts of cylinders.

4. High-vacuum molecular pump as in claim 2 wherein said surfaces of revolution include parts of cones.

5. High-vacuum molecular pump according to any one of the claims 1, characterized in that one of the elements is an immovably stator fixed, that the other element is rotatably arranged within the stator, and that the helical groove is provided in the stator.

6. High-vacuum molecular pump as in claim 1 wherein said two coaxial elements are a rotor and a stator, said rotor having a generally cylindircal body portion and an end portion of reduced cross-section projecting axially beyond said pump space and disposed within said annular gas supply chamber, said helical groove being in said stator and extending axially beyond said pump space to a position opposite said reduced end portion of said rotor.

* * * * *